United States Patent [19]

Matthews

[11] 4,038,019

[45] July 26, 1977

[54] FAIL-SAFE ENERGIZING CIRCUIT FOR A FUNCTIONAL DEVICE

[75] Inventor: Russell Byron Matthews, Goshen, Ind.

[73] Assignee: Johnson Controls, Inc., Milwaukee, Wis.

[21] Appl. No.: 611,961

[22] Filed: Sept. 10, 1975

[51] Int. Cl.[2] ..... F23Q 9/14

[52] U.S. Cl. ..... 431/51; 431/66; 431/78; 361/253

[58] Field of Search ..... 431/51, 66, 71, 78; 317/96

[56] References Cited

U.S. PATENT DOCUMENTS

| | | | |
|---|---|---|---|
| 3,291,183 | 12/1966 | Fairley | 431/66 |
| 3,510,236 | 5/1970 | Potts | 431/60 X |
| 3,583,843 | 6/1971 | Hirsbunner | 431/66 |
| 3,644,075 | 2/1972 | Squires | 431/66 |
| 3,734,676 | 5/1973 | Wyland | 431/79 |
| 3,829,276 | 8/1974 | Lenski | 431/79 X |
| 3,902,839 | 9/1975 | Matthews | 431/51 X |
| 3,923,445 | 12/1975 | Tyler | 431/71 |
| 3,938,937 | 2/1976 | Matthews | 431/78 |

*Primary Examiner*—Alan Cohan
*Assistant Examiner*—Gerald Michalsky
*Attorney, Agent, or Firm*—Johnson, Dienner, Emrich & Wagner

[57] ABSTRACT

A fail-safe energizing circuit for effecting the operation of a functional device, such as a relay, includes a resistor and a capacitor connected between outputs of an AC signal source which supplies an AC signal for charging the capacitor, a normally disabled silicon controlled rectifier connected in shunt with the capacitor and an operate coil of the relay and operable when enabled to provide a discharge path for the capacitor permitting the capacitor to discharge over the relay coil to operate the relay, and a control circuit operable to provide an enabling signal derived from the AC signal for enabling the silicon controlled rectifier. The energizing circuit is described with reference to an application in an automatic fuel ignition system for controlling the operation of a relay which energizes a fuel valve of the system.

20 Claims, 2 Drawing Figures

A
B
C
D
t

PILOT IGN. CKT. 20
TIMING NETWORK 44
INHIBIT CKT. 45
TIMING NETWORK 43
PULSE GEN. CKT. 40
ENERGIZING CIRCUIT 10
15 FUEL IGNITION SYSTEM
CONTROL CIRCUIT 19
L1
L2
L3
L4
THS
RIA
RIB
RIC
RI

FAIL-SAFE ENERGIZING CIRCUIT FOR A FUNCTIONAL DEVICE

BACKGROUND OF THE INVENTION

1. Field of the Invention.

This invention relates to circuits for controlling the energization of functional devices, and more particularly, to an energizing circuit employing a controlled switching device which effects fail-safe operation of a functional device in a system such as an automatic fuel ignition system.

2. Description of the Prior Art.

Many control applications require an energizing circuit which provides fail-safe operation of a functional device, such as a relay, to provide a desired control function. The energizing circuit may include a controlled switching device, typically a silicon controlled rectifier, which when triggered into conduction effects the operation of the relay. In some control circuits, such as the one shown in the U.S. Pat. No. 3,441,356 to L. H. Walbridge, wherein a silicon controlled rectifier is used to effect energization of a relay, the silicon controlled rectifier is connected in series with the relay between outputs of an energizing source. Thus, should the silicon controlled rectifier fail in the shorted mode, the relay will be operated. In certain applications, it is desirable that the relay not be operated in the event of a failure of the controlled switching device or some other component of the energizing circuit. One example of such system is an automatic fuel ignition system in which a relay is usually employed to control the energization of a fuel valve which supplies fuel to a burner apparatus for ignition by an ignition circuit. In such application, a failure of the controlled switching device, for example, could enable the relay to be operated or enable the relay to remain operated at a time when operation of the relay is unsafe or undesirable as for example when fuel would be supplied to the burner apparatus while the ignition circuit is not operating.

To prevent such occurrence, various "fail-safe" control circuits have been proposed which are operable to maintain a switching device, such as a relay, unoperated in the event of a component failure in the control circuit. In such circuits, the operation of the relay is usually effected by a silicon controlled rectifier, and the circuits prevent unsafe operation in the event of failure of components of the trigger circuit for the silicon controlled rectifier. However, most of these fail-safe circuits do not afford adequate protection in the event of failure of the silicon controlled rectifier itself.

One known circuit which provides fail-safe protection to prevent unsafe operation due to malfunctioning circuit components, including the silicon controlled rectifier, is disclosed in the U.S. Pat. No. 3,847,533 to W. J. Riordan. The circuit, which is described with reference to an automatic fuel ignition system of the direct ignition type, causes operation of a fuel valve through the discharging of a capacitor which is fully charged during each positive half cycle of an AC signal. A first silicon controlled rectifier which is fired periodically during each positive half cycle whenever a flame is not established, effects the discharge of the capacitor to operate the valve to supply fuel to a fuel outlet for ignition. A second silicon controlled rectifier is fired periodically during each negative half cycle when a flame is established to effect the discharge of the capacitor to maintain the valve operated. Since the circuit requires two silicon controlled rectifiers to permit initial operation of the valve and to maintain the valve operated, thereby it would appear the possibility of failure of the control device is increased. Also, while pulsed operation of the silicon controlled rectifiers is used to control the discharge of the capacitor, and lack of pulsing is indicative of a component failure, the circuit does not appear to employ the capacitor to prove the operability of the silicon controlled rectifiers.

SUMMARY OF THE INVENTION

It is an object of the present invention to provide a fail-safe energizing circuit for a functional device which provides reliable control of the energization of the functional device.

Another object of the invention is to provide a fail-safe energizing circuit in which energy stored by an energy storage means is transferred to a functional device under the control of an energy transfer means including a controlled switching device for operating the functional device, and in which the amount of energy stored by the energy storage means is limited, preventing operation of the functional device, in the event of failure of the controlled switching device.

It is yet another object of the invention to provide a fail-safe energizing circuit for use in a control system which prevents the occurrence of a condition, such as the energization of a fuel valve in an automatic fuel ignition system, where there is a component failure in the energizing circuit.

There and other objects are achieved by the present invention which has provided a fail-safe energizing circuit which is operable to effect the energization of a functional device only when certain conditions are provided for the energization circuit. The energizing circuit comprises energy storage means and means connecting said energy storage means to a source of a cyclical AC signal for supplying energy to said energy storage means during each positive half cycle of the AC signal, energy transfer means including a controlled switching device operable when enabled to connect said energy storage means to said functional device to permit the energy stored by said energy storage means to be transferred to said functional device, and condition sensing means responsive to a first condition to be operable in a first mode to maintain said controlled switching device disabled to permit said energy storage means to receive and store energy for each of a plurality of cycles of said AC signal, said condition sensing means being responsive to a second condition to be operable to enable said controlled switching device to transfer the energy stored in said energy storage means to said functional device to operate said functional device, and to thereafter enable said controlled switching device during each positive half cycle of the AC signal to transfer the energy stored in said energy storage means during each positive half cycle of the AC signal to said functional device to maintain said functional device operated.

In accordance with a disclosed embodiment, the energy storage means comprises a capacitor which is charged at a given rate by an AC signal provided by the energy source. The operation of the functional device is dependant upon the periodic charging and discharging of the capacitor over the functional device. The time the capacitor is permitted to charge and thus, the amount of charge, is determined by the time at which the controlled switching device is enabled by the condition sensing or control means.

In the disclosed embodiment, the control means derives an enabling signal from the AC signal for enabling the controlled switching device at a predetermined time relative to the charging time of the capacitor. To establish the turnon time for the controlled switching device, the control means includes a timing means which causes the controlled switching device to be enabled to permit the capacitor to discharge over the functional device at a time during each cycle before the capacitor has charged to provide discharge current of a first value which is sufficient to effect operation of the functional device. Such operation is similar to the condition which would occur for a component failure of the energizing circuit wherein the controlled switching device would be enabled early in the cycle, thereby limiting the charging of the capacitor and preventing operation of the functional device. This safety check is provided each time the circuit is enabled because a component failure which would normally enable the controlled switching device to fire early in the cycle prevents the buildup of the charge on the capacitor.

To permit operation of the functional device, an inhibit means of the control means is operable whenever the functional device is unoperated to delay the enabling signal for the controlled switching device for a predetermined number of cycles of the AC signal to permit the capacitor to store sufficient energy to operate the functional device. After the functional device has been operated, the inhibit means is disabled whereby the discharge current is limited to the first value, which maintains the functional device operated. If the controlled switching device should fail in the shorted mode, the capacitor does not charge due to the shunt path provided by the shorted controlled switching device. For a failure of the controlled switching device in the open mode, no discharge path is provided for the capacitor. In either case, failure of the controlled switching device does not result in the operation of the functional device.

The fail-safe energizing circuit may be employed in a proven pilot, automatic fuel ignition system to control the energization of a relay for effecting the operation of a fuel supply valve which supplies fuel to a burner apparatus for ignition. In such application, the control means is responsive to a predetermined condition, such as the establishing of a pilot flame, to provide enabling signals to the controlled switching device. The inhibit means delays the generation of such enabling signals for a predetermined number of cycles of the AC signal after the pilot flame is established to permit the capacitor to charge to a value which provides sufficient discharge current to operate the relay. At the end of such period, the controlled switching device is enabled to permit the capacitor to discharge over the operate coil of the relay to operate the relay. When the relay operates, the inhibit means is disabled and the controlled switching device is enabled during each cycle of the AC signal to discharge the capacitor over the relay to maintain the relay operated.

DESCRIPTION OF A PREFERRED EMBODIMENT

Figures 1, 2:
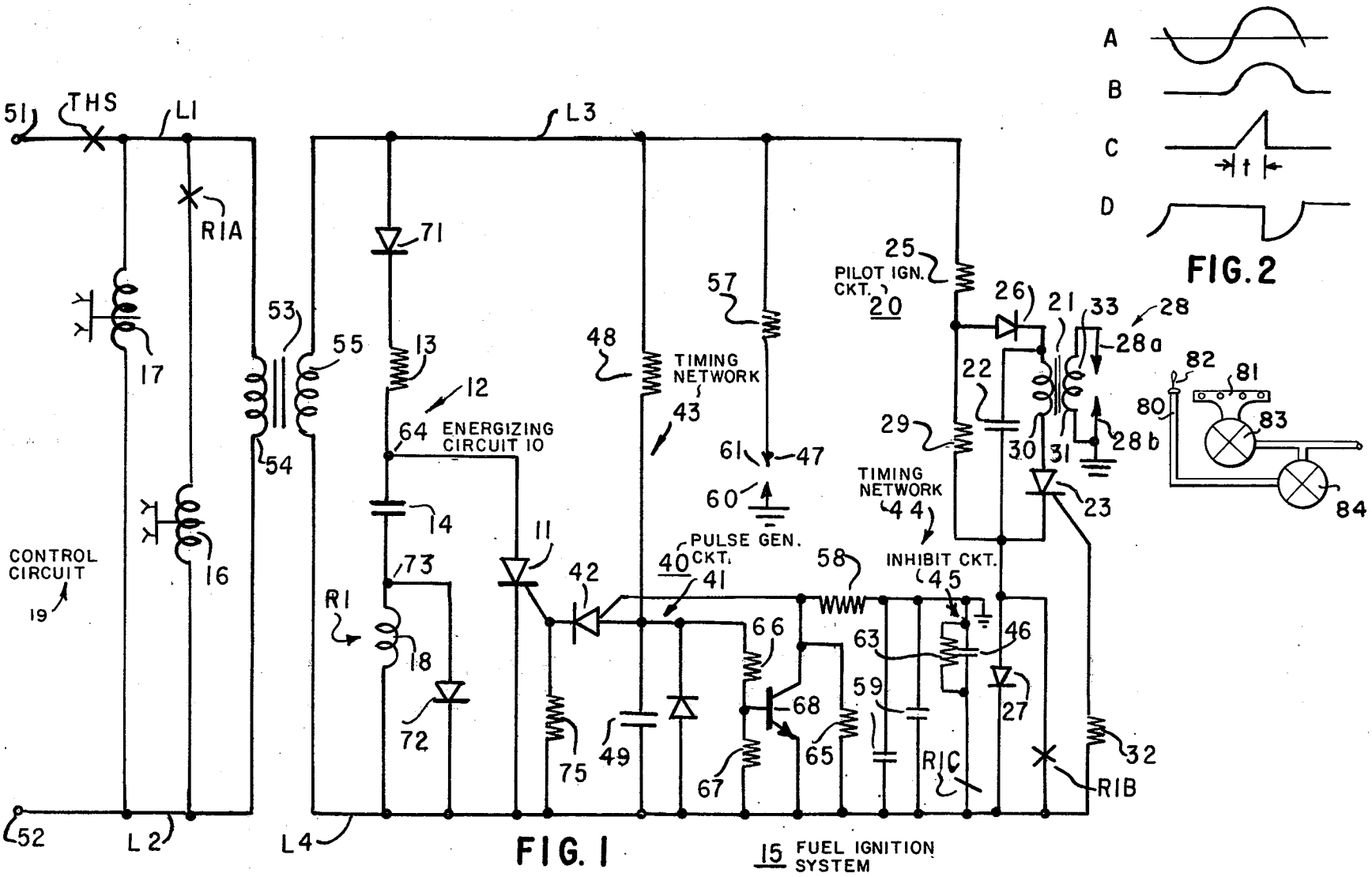
FIG. 1 is a schematic circuit diagram of a control circuit for an automatic fuel ignition system including the fail-safe energizing circuit of the present invention; and, FIG. 2 is a timing diagram showing waveforms for signals of the energizing circuit shown in FIG. 1.

Referring now to FIG. 1 of the drawings, there is shown a fail-safe energizing circuit 10 provided by the present invention for controlling the operation of a functional device. The energizing circuit 10 includes a controlled switching device 11, embodied as a silicon rectifier, and a timing network 12, including a resistor 13 and capacitor 14. By way of illustration, the fail-safe energizing circuit 10 is described with reference to an application in an automatic fuel ignition system having a control circuit 15 shown in FIG. 1. However, it is pointed out the energizing circuit 10 may be employed in other control applications where it is desirable to provide fail-safe operation of a functional device.

In the exemplary embodiment, the energizing circuit 10 is employed to control the energization of a relay R1 which effects energization of the operate coil 16 of a main fuel valve 83 of the fuel ignition system.

The fuel ignition system may be the type employing a pilot valve 84 having an operate coil 17 which is energized in response to operation of normally open contacts THS of a thermostatically controlled switch to supply gaseous fuel to a suitable pilot outlet 80 for ignition by a pilot ignition circuit 20 to establish a pilot flame 82. The pilot ignition circuit which is of the capacitor discharge type, includes an ignition transformer 21, a capacitor 22, which is periodically charged to a predetermined value, and a controlled switching device, embodied as a silicon controlled rectifier 23, operable to discharge the capacitor 22 over the ignition transformer 21 to effect the generation of ignition sparks between ignition electrodes 28, including a pair of electrodes, **28*a* and 28*b* which are located adjacent to the pilot outlet 80, for igniting fuel supplied to the pilot outlet 80 to establish a pilot flame 82**.

The energizing circuit 10 effects the operation of the main valve 83 whenever a pilot flame 82 is established to supply gas to a suitable main gas burner apparatus 81 for ignition by the pilot flame 82. The energizing circuit 10 also maintains the main gas valve operated as long as the pilot flame 82 remains established.

The control function provided by the energizing circuit 10 is based on the periodic charging and discharging of the capacitor 14 of the timing network 12 under the control of the silicon controlled rectifier 11. The timing network 12, including the capacitor 14, is connected between conductors L3 and L4. Whenever the silicon controlled rectifier 11 is non-conducting, the capacitor 14 is charged by an AC signal provided over conductors L3 and L4. When the silicon controlled rectifier 11 is enabled, the capacitor 14 is discharged through the operate coil 18 of the relay R1. Energy can only be stored by the capacitor 14 if the silicon controlled rectifier 11 is not conducting for a portion of the cycle.

For the purpose of enabling the silicon controlled rectifier 11 to effect the discharge of the capacitor 14, the fuel ignition system 15 further includes a control circuit 40 which senses the pilot flame and provides enabling pulses for the silicon controlled rectifier 11 during each cycle of the AC signal.

The control circuit 40 includes a pulse generating circuit 41 comprised of a controlled switching device 42 and associated timing networks 43 and 44 which control the enabling of the controlled switching device 42 such that the controlled switching device 42 is normally conducting at a very low energy level, insufficient to enable the silicon controlled rectifier 11 whenever the pilot flame is extinguished and is periodically rendered conductive to provide enabling pulses at a higher energy level for the silicon controlled rectifier 11 whenever a pilot flame is established.

The control circuit 40 is operable whenever the pilot flame is established to derive an enabling signal from the AC signal for enabling the silicon controlled rectifier 11 at a predetermined time after the start of each positive half cycle of the AC signal. The timing networks 43 and 44 establish the turnon time for the controlled switching device 42 which causes the silicon controlled rectifier 11 to be enabled to permit the capacitor 14 to discharge over the relay coil 18 at a time during each positive half cycle after the capacitor 14 has charged to provide discharge current of value which is sufficient to maintain the relay R1 operated. Such operation is similar to the condition which would occur for a component failure of the energizing circuit 10 wherein the silicon controlled rectifier 11 would be enabled early in the cycle, thereby limiting the charging of the capacitor 14 and preventing operation of the relay R1.

An inhibit circuit 45, including capacitor 46, delays the enabling of the controlled switching device 42 for a predetermined number of cycles of the AC signal maintaining the silicon controlled rectifier 11 non-conducting, to permit the capacitor 14 to store sufficient energy to operate the relay R1. After the relay R1 has been operated, the inhibit circuit 45 is disabled whereby the discharge current is limited to a lower value which is sufficient to keep relay R1 operated.

Considering the automatic fuel ignition system 15 in more detail, the control circuit 19 has a pair of input terminals 51 and 52 which are connectable to a 120 VAC source for supplying power to the circuit 15. Terminal 51 is connected over normally open, thermostatically-controlled contacts THS to a conductor L1, and terminal 52 is connected directly to a further conductor L2.

The pilot valve operate coil 17 is connected between conductors L1 and L2 and is energized whenever contacts THS are closed to operate the pilot valve 84 to supply fuel to the pilot outlet for ignition by the ignition circuit 20 to establish a pilot flame.

The main valve operate coil 16 is connected over normally open contacts RIA of relay R1 between conductors L1 and L2 and is energized whenever relay R1 is operated and the pilot flame is established, to operate the main valve 83 to supply fuel to a burner apparatus for ignition by the pilot flame.

A supply transformer 53, supplies AC power extended to conductors L1 and L2 to the control circuit 40, the ignition circuit 20, and the energizing circuit 10 over conductors L3 and L4. The transformer 53 has a primary winding 54 connected between conductors L1 and L2, and a secondary winding 55 connected between conductors L3 and L4 such that when AC power is applied to conductors L1 and L2 in response to operation of contacts THS, the 120 VAC power is also supplied to conductors L3 and L4.

Referring now to the ignition circuit 20, the capacitor 22 is connected in a series charging circuit which extends from conductor L3, a resistor 25, a diode 26, the capacitor 22, and a diode 27 to conductor L4. Normally open contacts R1B are connected in shunt with diode 27. A resistor 29 is connected in parallel with diode 26 and the capacitor 22. The silicon controlled rectifier 23 is connected in series with a primary winding 30 of the ignition transformer 21 in parallel with the capacitor 22. The gate electrode of the silicon controlled rectifier 23 is connected over a resistor 32 to conductor L4. The ignition electrodes 28, include a pair of electrodes **28*a* and 28*b* which are connected to opposite ends to the secondary winding 31 of the ignition transformer 21, and disposed adjacent the pilot outlet (not shown) in a spaced relationship, providing a gap 33** there between.

Ignition electrode **28*b*** is connected to a ground reference point, which may, for example, be a metallic ground provided by the pilot outlet or the burner apparatus.

In operation, whenever AC power is applied to conductors L3 and L4 in response to the closing of contacts THS, the capacitor 22 is charged during positive half cycles of the AC signal, that is, when conductor L3 is positive relative to conductor L4, over the charging path established over resistors 25, diode 26, the capacitor 22 and diode 27.

During negative half cycles, that is, when conductor L4 is positive relative to conductor L3, the silicon controlled rectifier 23 is rendered conductive, enabling capacitor 22 to discharge through winding 30 such that the capacitive discharge current causes a voltage pulse to be induced in the secondary winding 31 which is applied to the ignition electrodes 28 generating a spark for igniting the pilot gas supplied to the pilot outlet to establish a pilot flame.

Contact R1B of relay R1 shorts out the firing signal during this negative portion of the cycle to turn off the spark when pilot flame has been established. Referring to the control circuit 40, the controlled switching device 42 is embodied as a programmable unijunction transistor (PUT), such as the type 2N6028, commercially available from Motorola. The timing network 43, including resistor 48 and capacitor 49, serves as anode control network for the PUT device 42, and the timing network 44, including resistors 57 and 58 and capacitors 59, serves as a gate control network for the PUT device 42.

The control circuit 40 further includes a flame sensing electrode 47 connected to resistor 57 and conductor L3. The electrode 47 is positioned in a spaced-relationship with a ground reference point 60 for the fuel ignition control circuit 15, normally providing a high resistance path, virtually an open circuit, between conductor L3 and the reference point 60. The ground reference point 60 may, for example, be a metallic ground provided by a gas burner apparatus or the pilot outlet. The flame sensing electrode 47 is located in the region in which the pilot flame is to be produced such that the pilot flame will bridge the gap 61 between the electrode 47 and the reference point 60 providing a conductance consisting of a resistance and flame rectifier over the electrode 47 between conductor L3 and the reference point 60 whenever the pilot flame is established.

The gate control network 44 determines the gate potential for the normally non-conducting PUT device 42. The gate control network 44 includes redundant capacitors 59 which are connected in parallel between the reference point 60 and conductor L2. Whenever the pilot flame bridges the gap 61 between the sensing electrode 47 and the reference point 60, the resistance of the charging path for the capacitors 59 is reduced and the capacitors 59 charge.

The gate control network 44 also includes an inhibit circuit 45 consisting of a capacitor 46 and a shunt resistor 63 which are connected in series with normally closed contacts R1C of relay R1. When a pilot flame is established, as previously described, flame rectified current flows through the high resistance of the pilot flame to charge capacitor 46 and redundant capacitors 59. Capacitor 46 is large compared to redundant capacitor 59, approximately ten times greater. The flame resistance of the pilot flame and the combined capacitance of capacitors 59 and 46 constitute a time delay of approximately 1 second. This gives capacitor 14 time to charge to a value sufficient to energize relay R1 when silicon controlled rectifier conducts.

In effect, capacitor 46 delays the application of the flame signal to the gate of PUT device 42 for a finite time sufficient for capacitor 14 to charge.

When relay R1 is energized, contacts R1C open to remove capacitor 46 from the circuit so that fast response on flame out is maintained. If capacitor 46 was not removed from the circuit through operation of contacts R1C, the flame response time on flame out conditions would exceed 0.8 seconds for safe operation. Resistor 63 is provided to bleed the charge off of capacitor 46 to get it ready for next ignition attempt.

An unsafe fault on any of the components to the left of the redundant capacitors 59 will cause silicon controlled rectifier to conduct as soon as the system is energized thereby preventing build-up of charge on capacitor 14 and thereby preventing actuation of relay R1.

The gate control network 44 further includes resistor 58, which is connected between the reference point 60 and the gate electrode of the PUT device 42, and a resistor 65, which is connected between the gate electrode of the PUT device 42 and conductor L4. Resistors 58 and 65 form a bleeder path for the capacitors 59.

In addition, resistors 66 and 67, which are serially connected between the anode electrode of the PUT device 42, and conductor L4, and a transistor 68, having its collector-emitter circuit connected between the gate electrode of the PUT device 42 and conductor L4, and its base connected to the junction of resistors 66 and 67, form a clamping circuit to limit voltage swing at the gate of the PUT device 42 to a predetermined amount.

The potential at the anode electrode of the PUT device 42 is determined by the anode control network 43. The anode control network 43 includes a capacitor 49 which is connected between the anode electrode of the PUT device 42 and conductor L2. The anode control network 43 further includes resistor 48 which is connected between conductor L3 and the anode electrode of the PUT device 42 and thus to one side of capacitor 49. Accordingly, a charging path is provided for capacitor 49 from conductor L3 over resistor 48 and capacitor 49 to conductor L4.

The PUT device 42 conducts whenever the potential at the anode electrode exceeds the potential at the gate electrode by approximately 0.6 volts as determined by the action of the anode control network 43 and the gate control network 44. For the condition where the pilot flame is not established, the PUT device 42 conducts at a time when capacitor 49 stores low energy. When the pilot flame is established, the PUT device 42 conducts at a time when the capacitor 49 stores a greater amount of energy which is sufficient to render the silicon controlled rectifier 11 conducting.

Whenever the PUT device 42 is rendered conductive a discharge path is provided for capacitor 49 over the anode-cathode circuit of the PUT device 42 which supplies pulses provided by the control circuit 40 to the gate electrode of silicon controlled rectifier of the energizing circuit 10. The silicon controlled rectifier 11 may be the type C106B, manufactured by General Electric Company.

With reference to the energizing circuit 10, the timing network 12 includes diode 71, the resistor 13, the capacitor 14 and a diode 72, which are connected in series between conductors L3 and L4 forming a series unidirectional charging path for capacitor 14. The operate coil 18 of relay R1 is connected between one side of capacitor 14 at point 73 and conductor L4. The silicon controlled rectifier 11 has its anode connected to the other side of capacitor 14 at point 64 and its cathode connected to conductor L4. The gate electrode of the silicon controlled rectifier 11 is connected to the output of the control circuit 40 at the cathode of the PUT device 42, and over a resistor 75 to conductor L4.

The silicon controlled rectifier 11 is normally nonconducting and thus enables capacitor 14 to be charged during positive half cycles of the AC signal provided supplied to conductors L3 and L4 when contacts THS are operated. The silicon controlled rectifier 11, is operable to provide a shunt path for capacitor 14 and the operate coil 18 of the relay R1, permitting the capacitor 14 to discharge over the coil 18. When the capacitor 14 has stored sufficient energy, the relay R1 is operated when the capacitor 14 is discharged over the operate coil 18 of the relay R1.

Relay R1, may comprise an A.C. relay having a low coil resistance of approximately 800 ohms so that the capacitor 14 can provide sufficient discharge to effect energization of the relay R1.

Relay R1, which is normally de-energized, has normally open contacts R1A which are connected in series with the main valve operate coil 16 between conductors L1 and L2, normally open contacts R1B connected in the ignition circuit 20, and normally closed contacts R1C which normally connect the inhibit circuit 45 to the gate control network 44.

Whenever the fuel ignition control circuit 15 is energized, relay R1 will be de-energized in the absence of a pilot flame, permitting current flow over the normally open contacts R1B from conductor L3 to the ignition circuit 20 to effect the generation of ignition sparks between the ignition electrodes 28.

When the pilot gas is lit and the silicon controlled rectifier 11 is rendered conductive by the pulse output of the control circuit 40, energization of relay R1 is effected. As relay R1 operates, contacts R1B are closed thereby terminating the generation of the ignition sparks, contacts R1C are opened, disabling the inhibit circuit 45, and contacts R1A are closed, energizing the main burner gas valve coil 16.

OPERATION

For purposes of illustration of operation of the fuel ignition control circuit 15, including the fail-safe energizing circuit 10, it is assumed that the control circuit 15 is initially unenergized, that the silicon controlled rectifier 11 and the PUT device 42 are cut-off, that relay R1 is deenergized and that capacitor 14 is discharged.

When contacts THS operate to permit the 120 VAC signal to be applied to conductors L1 and L2, the pilot valve coil 17 is energized to operate the pilot valve 84 to supply fuel to the pilot outlet. Also, AC power is supplied over transformer 53 to conductors L3 and L4 causing energization of the ignition circuit 20 which is operable in the manner described above to effect the generation of ignition sparks between the ignition electrode 28 for igniting the fuel supplied to the pilot outlet to establish a pilot flame.

In addition, with reference to FIG. 2, when conductor L3 begins to swing positive as indicated in line A of FIG. 2, current flows over the timing network 12 from conductor L3 over diode 71, resistor 13, the capacitor 14 and diode 72, charging the capacitor 14. During the same positive half cycle, capacitor 49 also charges raising the potential at the anode of the PUT device 42. However, prior to the time the pilot flame is established, capacitors 46 and 59 remain discharged, and thus the PUT device 42 conducts early in the positive half cycle and before capacitor 49 has stored sufficient charge to effect turnon of the silicon controlled rectifier 11 to cause capacitor 14 to discharge.

Accordingly, assuming the pilot flame is established, then during the next positive half cycle of the AC signal applied between conductors L3 and L4 when conductor L3 swings positive relative to conductor L4, current flows from conductor L3, resistor 57, sensing electrode 47 and the pilot flame to the reference point 60, and over capacitors 59 and 46 to conductor L4, permitting capacitors 59 and 46 to charge. The voltage across capacitors 59, which are connected over resistor 58 to the gate electrode of the PUT device 42, establishes a gate potential for the PUT device 42. However, as indicated above, capacitor 46 delays the application of the flame signal to the gate of the PUT device 42 for a finite time, sufficient to permit capacitor 14 to charge.

During the same half cycle, capacitor 49 is charged over a path extending from conductor L3 over resistor 48 and capacitor 49 to conductor L4, establishing a potential at the anode electrode of the PUT device 42.

The values of capacitors 49 and 59 are selected such that some time before the peak of the AC line voltage during the first half cycle of the AC line signal, the anode to gate potential of the PUT device 42 exceeds +0.6 volts so that the PUT device 42 is rendered conductive, permitting capacitor 49 to discharge over the PUT device 42. Also, capacitor 49 is charged to a voltage sufficient to effect the generation of a voltage pulse across the resistor 75 capable of rendering the silicon controlled rectifier 11 conductive. The speed of response of the control circuit 40 is a function of the values of capacitors 59 and resistors 58 and 65 which form the bleeder path for capacitors 59.

It should be understood that the only time pulses are supplied to the gate of the silicon controlled rectifier 11 is when the voltage at the anode electrode of the PUT device 42 exceeds that of the gate electrode +0.6 volts, and the silicon controlled rectifier 11 is enabled only when the capacitor 49 has charged sufficiently to provide the pulse energy required to render the silicon controlled rectifier 11 conductive.

When the silicon controlled rectifier 11 is rendered conductive, a discharge path is provided for capacitor 14 over relay R1 which then operates, closing contacts R1B to inhibit further sparking between the ignition electrodes 28 of the ignition circuit 20 and closing contacts R1B to energize the main fuel valve coil 16. In addition, contacts R1C are opened, disabling the circuit 45.

Once the pilot flame has been established and bridges the gap between the sensing electrode 47 and the reference point 60, the control circuit 40 provides enabling pulses to the gate of the silicon controlled rectifier 11 during alternate half cycles of the applied AC line signal. During the next half cycle of the AC line signal, when conductor L4 swings positive relative to conductor L3, the silicon controlled rectifier 11 is cut off. However relay R1 is maintained energized by the energy stored in the relay magnetic field resulting in a current flow through "free-wheeling" diode 72 and relay coil 18 as the magnetic field decays.

The transfer of energy from capacitor 14 to relay R1 takes place every cycle as long as the pilot flame is established, to maintain relay R1 operated. During each positive half cycle, charging current supplied to capacitor 14 as shown in line B of FIG. 2, causes the voltage across the silicon controlled rectifier 11, which is non-conducting, to increase as shown in line C of FIG. 2. Current flow is provided over both timing networks 43 and 44 permitting capacitors 49 and 59 to charge. As indicated above, when the pilot flame is established, the charging of capacitor 59 causes the PUT device 42 to be maintained non-conducting for a longer time to permit capacitor 49 to be charged to a voltage sufficient to trigger the silicon controlled rectifier 11 into conduction. The time constant of timing network 43, that is, resistor 48 and capacitor 49, is chosen so that the PUT device 42 and thus the silicon controlled rectifier 11 are maintained non-conducting for the first one-fourth cycle of the AC signal, but are enabled at a time t, shown in line C of FIG. 2, which is early in the positive half cycle. The time constant of timing network 12 of the energizing circuit 10 is chosen to be shorter than the time constant of timing network 43. Accordingly, since when the silicon controlled rectifier is rendered conductive, the capacitor 14 is discharged over the relay coil 18 providing discharge current as shown in line D of FIG. 2, the early firing time of the silicon controlled rectifier 11 limits the charging of capacitor 14 to a low value, such as 10 volts. Such voltage provides sufficient discharge current for maintaining the relay R1 operated, but is insufficient to operate the relay R1. Accordingly, the silicon controlled rectifier 11 is prevented from firing during the first one fourth cycle of the positive swing of each cycle of the signal, and the capacitor 14 is enabled to store sufficient energy during each cycle to maintain the relay R1 operated, the continued operation of the relay R1 indicating that the silicon controlled rectifier 11 is operating properly. If the silicon controlled rectifier 11 should fail in the shorted mode or diode mode, the time t would be reduced to zero and the amount of energy stored on the capacitor would be very small because the capacitor 14 in effect be shorted by the silicon controlled rectifier 11 with approximately a 0.6 volt drop.

For the condition when the pilot flame is not established before the capacitor 14 is fully charged, a high impedance path, which for all practical purposes is open circuit, is provided over the sensing electrode 47 to reference point 60 such that capacitors 59 discharge. Accordingly, as capacitor 49 charges while capacitors 59 remain discharged, the voltage at the gate electrode of the PUT device 42 is lower relative to the voltage at the anode electrode. Consequently, the anode voltage exceeds the gate voltage early in the half cycle of the AC line signal before capacitor 49 is fully charged. The charge on capacitor 49 is limited by the early firing of the PUT device 42 to a value less than that required to trigger the silicon controlled rectifier 11 into conduction. Thus, when the pilot flame is not present, pulses provided by the control circuit 40 are ineffective to enable silicon controlled rectifier 11 to cause relay R1 to be energized.

When the pilot flame is established and relay R1 is operated, the main fuel valve coil 16 is energized to operate the main valve 83 permitting gas to flow to the burner apparatus for ignition by the pilot flame.

For a flame out condition, the operation of the control circuit 40 is the same as described above for the condition where the capacitor 14 has been fully charged before the pilot flame was established. That is, the PUT device 42 is enabled early in the cycle at a time before capacitor 49 has charged to a value sufficient to effect the enabling of the silicon controlled rectifier 11. Accordingly, capacitor 14 is prevented from discharging, and relay R1 becomes deenergized. When relay R1 releases, contacts R1A open to deenergize the main valve coil 16, contacts R1B open to energize the ignition circuit 20, and contacts R1C close to enable the inhibit circuit 45, and a trial for ignition is initiated as described above.

It is apparent that in the event of a line voltage interruption which causes deenergization of the relay R1, but is too fast to allow the pilot flame to extinguish, the main fuel valve 83 drops out. Although the control circuit 40 is normally operable to enable the silicon controlled rectifier 11 during each cycle of the AC signal, thereby limiting the charging of capacitor 14, whenever the pilot flame is established, when relay R1 releases, the inhibit circuit 45 is enabled, thereby inhibiting the conrol circuit 40 until capacitor 14 is fully charged to a value sufficient to effect operation of the relay R1 to permit the main valve 83 to be operated.

I claim:

1. In a fail-safe energizing circuit for controlling the operation of a functional device, a capacitance means, means connecting said capacitance means to a source of a cyclical AC signal to enable said capacitance means to charge during a portion of alternate half cycles of the AC signal, a normally disabled controlled switching device operable when enabled to connect said capacitance means in a circuit path with said functional device to permit said capacitance means to discharge over said functional device, and condition sensing means for controlling the enabling of said controlled switching device, said condition sensing means being responsive to a first condition to be operable in a first mode to maintain said controlled switching device disabled for a plurality of cycles of said AC signal to permit said capacitance means to be charged to a predetermined value and to then be operable in said second mode to enable said controlled switching device, permitting said capacitance means to discharge over said functional device to operate said functional device, and to thereafter enable said controlled switching device during said alternate half cycles of the AC signal permitting said capacitance means to discharge over said functional device during each cycle of the AC signal to maintain said functional device operated.

2. An energizing circuit as set forth in claim 1 wherein said condition sensing means includes timing means which delays the enabling of said controlled switching device whenever said condition sensing means is operable in said first mode, to enable said capacitance means to be charged to said predetermined value which provides sufficient discharge current for operating said functional device, and when said condition sensing means is operable in said second mode said timing means causing the charging of said capacitance means to be limited to a value which provides discharge current of a lesser value that is sufficient only to maintain said functional device operated.

3. In a fail-safe energizing circuit for controlling the operation of a functional device, a first circuit branch including capacitance means and circuit means connecting said capacitance means in a unidirectional charging circuit between outputs of a source of a cyclical AC signal to permit said capacitance means to charge to a first value during alternate half cycles of said AC signal, a second circuit branch including said capacitance means and said functional device, a normally disabled controlled switching device connected in shunt with said capacitance means and said functional device for controlling the charging and discharging of said capacitance means, and control means for controlling the enabling of said controlled switching device, said control means being operable in a first mode to maintain said controlled switching device disabled for a plurality of cycles of said AC signal to permit said capacitance means to charge to a second value that is greater than said first value, and to then be operable in a second mode to enable said controlled switching device to permit said capacitance means to discharge over said functional device for operating said functional device, and to thereafter enable said controlled switching device during each of said alternate half cycles of said AC signal to permit said capacitance means to discharge over said functional device for maintaining said functional device operated.

4. An energizing circuit as set forth in claim 3 wherein said circuit means includes resistance means for enabling said capacitance means to charge at a given rate, and wherein said control means includes switching means and further capacitance means and further resistance means for controlling the operation of said switching means, said further capacitance means and further resistance means being connected between said outputs of said source to permit said further capacitance means to charge at a slower rate to control said switching means to enable said controlled switching device at a predetermined time after the start of each of said alternate half cycles of said AC signal whenever said control means is operable in said second mode.

5. An energizing circuit as set forth in claim 3 wherein said controlled switching device comprises a silicon controlled rectifier having its anode-cathode circuit connected in shunt with said capacitance means and said functional device, and having its gate electrode connected to an output of said control means.

6. An energizing circuit as set forth in claim 3 wherein said control means includes pulse generating means operable in response to a first condition to provide pulses for enabling said controlled switching device.

7. An energizing circuit as set forth in claim 6 wherein said control means includes inhibit means to inhibit said pulse generating means to thereby delay the enabling of said controlled switching device for a predetermined duration after the occurrence of said first condition.

8. An energizing circuit as set forth in claim 7 wherein said functional device is operable when enabled to disable said inhibit means to permit said pulse generating means to provide pulses for enabling said controlled switching device during each cycle of said AC signal whenever said functional device is operated. said control arrangement further including flame sensing means for controlling the enabling of said controlled switching device, said flame sensing means being responsive to a pilot flame to be operable in a first mode to maintain said controlled switching device disabled for a plurality of cycles of said AC signal to permit said capacitance means to charge to a predetermined value, and to then enable said controlled switching device during the next one of said alternate half cycles of the AC signal to permit said capacitance means to discharge over said switching means to operate said switching means, and to thereafter enable said controlled switching device during each alternate half cycle of the AC signal while the pilot flame remains established to permit said capacitance means to discharge over said switching means during said alternate half cycles of the AC signal to maintain said switching means operated.

9. In a fuel ignition system including pilot source means operable when enabled to provide a pilot flame, and main valve means operable when energized to supply fuel to a burner apparatus for ignition by said pilot flame, a control arrangement comprising switching means operable when enabled to effect operation of said valve means, capacitance means, means connecting said capacitance means to a source of a cyclical AC signal to enable said capacitance means to charge during a portion of alternate cycles of the AC signal, a normally disabled controlled switching device operable when enabled to connect said capacitance means in a circuit path with said switching means to permit said capacitance means to discharge over said switching means, said conrol arrangement further including flame sensing means for controlling the enabling of said controlled switching device, said flame sensing means being responsive to a pilot flame to be operable in a first mode to maintain said controlled switching device disabled for a plurality of cycles of said AC signal to permit said capacitance means to charge to a predetermined value, and to then enable said controlled switching device during the next one of said alternate half cycles of the AC signal to permit said capacitance means to discharge over said switching means to operate said switching means, and to thereafter enable said controlled switching device during each alternate half cycle of the AC signal while the pilot flame remains established to permit said capacitance means to discharge over said switching means during said alternate half cycles of the AC signal to maintain said switching means operated.

10. A system as set forth in claim 9 wherein said flame sensing means includes timing means operable in the absence of a pilot flame to enable said capacitance means to be charged to a value which provides sufficient discharge current for operating said switching means, said timing means being operable whenever the pilot flame is established to cause the charging of said capacitance means to be limited to a value which provides discharge current of a lesser value that is sufficient only to maintain said switching means operated.

11. A system as set forth in claim 9 wherein said capacitance means charges during a first portion of each of said alternate half cycles of the AC signal, and wherein said flame sensing means includes control means operable whenever a pilot flame is established to provide an enabling signal derived from said AC signal for enabling said controlled switching device at a predetermined time after the start of each of said alternate half cycles of the AC signal.

12. A system as set forth in claim 11 wherein said circuit means includes resistance means for enabling said capacitance means to charge at a given rate, and wherein said control means includes further capacitance means and further resistance means connected to said outputs of said source for charging said further capacitance means, said further capacitance means charging at a slower rate to enable said control means to provide said enabling signal at said predetermined time.

13. A system as set forth in claim 11 wherein said control means includes pulse generating means operable in response to a first condition to provide pulses for enabling said controlled switching device.

14. A system as set forth in claim 13 wherein said control means includes inhibit means to inhibit said pulse generating means to thereby delay the enabling of said controlled switching device for a predetermined duration after the occurrence of said first condition.

15. A system as set forth in claim 14 wherein said inhibit means inhibits the enabling of said controlled switching device for said predetermined number of cycles of said AC signal whenever said switching means is disabled, while the pilot flame remains established.

16. An energizing circuit as set forth in claim 14 wherein said switching means is operable when enabled to disable said inhibit means to permit said pulse generating means to provide pulses for enabling said controlled switching device during each cycle of said AC signal whenever said switching means is operated.

17. A system as set forth in claim 9 wherein said controlled switching device comprises a silicon controlled rectifier having its anode-cathode circuit connected in shunt with said capacitance means and said switching means, and having its gate electrode connected to an output of said control means.

18. In a fuel ignition system including valve means operable when energized to supply fuel to a burner apparatus for ignition, a control arrangement comprising switching means operable when energized to effect the operation of said valve means, energizing circuit means including a first circuit branch including capacitance means and circuit means connecting said capacitance means in a unidirectional charging circuit between outputs of a source of a cyclical AC signal to permit said capacitance means to charge to a first value during alternate half cycles of said AC signal, a second circuit branch including said capacitance means, said switching means, and a controlled switching device connected in shunt with said capacitance means and said switching means, and control means for controlling the enabling of said controlled switching device, said control means being operable in a first mode to maintain said controlled switching device disabled for a plurality of cycles of said AC signal to permit said capacitance means to charge over said first branch to a second value that is greater than said first value, said control means being operable in a second mode to enable said controlled switching device to permit said capacitance means to discharge over said second branch including said switching means causing said switching means to operate whenever said capacitance means has charged to said second value, and to thereafter enable said controlled switching device during each of said alternate half cycles of said AC signal to permit said capacitance means to discharge over said switching means to maintain said switching means operated.

19. In a fuel ignition system including valve means operable when energized to supply fuel to a burner apparatus for ignition, a control arrangement comprising first switching means operable when energized to effect operation of said valve means, energizing circuit means including first timing means having first capacitance means and first resistance means connected to a signal source which provides a cyclical AC signal to permit said first capacitance means to be charged by said AC signal at a first rate during each cycle of the AC signal, second switching means normally disabled and operable when enabled to connect said capacitance means in a circuit path with said first switching means to provide a discharge path for said first capacitance means over said first switching means for controlling the operation of said first switching means, and control means operable in response to a predetermined condition to generate an enabling signal for effecting the enabling of said second switching means during each cycle of the AC signal, said control means including second timing means having second capacitance means and second resistance means connected to said signal source to permit said second capacitance means to be charged by said AC signal at a second rate which is slower than said first rate to effect the generation of the enabling signal whereby said enabling signal is normally generated at a time during each cycle of the AC signal when said first capacitance means is charged to a first value which is insufficient to effect operation of said first switching means, and inhibit means for delaying the generation of said enabling signal for a predetermined time to maintain said second switching means disabled for a plurality of cycles of the AC signal after the occurrence of said condition to permit said first capacitance means to charge during said plurality of cycles of the AC signal whereby said first capacitance means is charged to a second value which is sufficient to effect operation of said first switching means before said second switching means is enabled.

20. A system as set forth in claim 19 which includes pilot source means operable when enabled to establish a pilot flame, said control means including third timing means for permitting said enabling signal to be provided whenever a pilot flame is established.

* * * * *

UNITED STATES PATENT OFFICE

CERTIFICATE OF CORRECTION

Patent No. 4,038,019 Dated July 26, 1977

Inventor(s) Russell Byron Matthews

It is certified that error appears in the above-identified patent and that said Letters Patent are hereby corrected as shown below:

Column 13, lines 1-18, cancel "said control arrangement... switching means operated.".

Column 13, line 33, change "conrol" to -- control --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*